US009975336B2

(12) United States Patent
Hashiguchi et al.

(10) Patent No.: US 9,975,336 B2
(45) Date of Patent: May 22, 2018

(54) INKJET HEAD AND PRINTER FOR REDUCING INFLUENCE OF FLEXIBLE CIRCUIT ON PIEZOELECTRIC ACTUATOR SUBSTRATE OPERATION

(71) Applicant: KYOCERA Corporation, Kyoto-shi, Kyoto (JP)

(72) Inventors: Takuji Hashiguchi, Kyoto (JP); Chitoshi Ueki, Kyoto (JP)

(73) Assignee: KYOCERA Corporation, Kyoto-Shi, Kyoto (JP)

( * ) Notice: Subject to any disclaimer, the term of this patent is extended or adjusted under 35 U.S.C. 154(b) by 18 days.

(21) Appl. No.: 15/087,051

(22) Filed: Mar. 31, 2016

(65) Prior Publication Data

US 2017/0157930 A1 Jun. 8, 2017

Related U.S. Application Data

(63) Continuation of application No. PCT/JP2015/071145, filed on Jul. 24, 2015.

(30) Foreign Application Priority Data

Jul. 30, 2014 (JP) ..... 2014-154771

(51) Int. Cl.
*B41J 2/14* (2006.01)

(52) U.S. Cl.
CPC .. *B41J 2/14201* (2013.01); *B41J 2002/14491* (2013.01)

(58) Field of Classification Search
CPC ..... B41J 2/14201
See application file for complete search history.

(56) References Cited

U.S. PATENT DOCUMENTS

2005/0264617 A1* 12/2005 Nishimura ..... B41J 2/14314 347/70
2008/0309734 A1 12/2008 Nishimura et al.
(Continued)

FOREIGN PATENT DOCUMENTS

JP 2001-277505 A 10/2001
JP 2002-331667 A 11/2002
(Continued)

OTHER PUBLICATIONS

International Search Report, PCT/JP2015/071145, dated Aug. 25, 2015, 2 pgs.
(Continued)

*Primary Examiner* — Bradley Thies
(74) *Attorney, Agent, or Firm* — Volpe and Koenig, P.C.

(57) ABSTRACT

In a head, a passageway member has a nozzle which is opened in a first major surface, and a pressurizing chamber which is communicated with the nozzle and is positioned on a second major surface side as the back face of the first major surface. A piezoelectric actuator substrate is superimposed on the second major surface and covers over the pressurizing chamber. An FPC 27 has an insulating base film, an interconnect which is provided on one major surface of the base film, and an insulating film covering the interconnect, and makes its insulating film side face to the side of the piezoelectric actuator substrate which is opposite to the passageway member side. Above the pressurizing chambers, a thickness T of the insulating film from the base film is different between one side and the other side in a predetermined direction along the second major surface.

20 Claims, 8 Drawing Sheets

(56) References Cited

U.S. PATENT DOCUMENTS

| | | | |
|---|---|---|---|
| 2012/0236083 | A1 | 9/2012 | Mizukami et al. |
| 2014/0063126 | A1 | 3/2014 | Yamashita et al. |
| 2014/0092177 | A1 | 4/2014 | Sugahara et al. |

FOREIGN PATENT DOCUMENTS

| | | | | |
|---|---|---|---|---|
| JP | 2003-182070 | A | | 7/2003 |
| JP | 2004-098585 | A | | 4/2004 |
| JP | 2005-007735 | A | | 1/2005 |
| JP | 2010-105317 | A | | 5/2010 |
| JP | 2010-129873 | A | | 6/2010 |
| JP | 2010129873 | A | * | 6/2010 |
| JP | 2012-196838 | A | | 10/2012 |

OTHER PUBLICATIONS

Extended European Search Report, European Application No. 15826699.9, dated Mar. 26, 2018, 7 pgs.

* cited by examiner

INKJET HEAD AND PRINTER FOR REDUCING INFLUENCE OF FLEXIBLE CIRCUIT ON PIEZOELECTRIC ACTUATOR SUBSTRATE OPERATION

TECHNICAL FIELD

The present invention relates to an inkjet head and a printer.

BACKGROUND ART

Known in the art is a piezo type inkjet head (for example Patent Literature 1). This type of inkjet head has a passageway member in which ink passageways are formed, a piezoelectric actuator substrate which is superimposed on the passageway member, and a flexible printed circuit covering the surface of the piezoelectric actuator substrate on the side opposite to the passageway member. The passageway member has nozzles for ejecting ink and pressurizing chambers which are communicated with the nozzles and open at the sides opposite to opening directions of the nozzles. The piezoelectric actuator substrate closes the pressurizing chambers, bends into the pressurizing chambers due to a backward voltage effect when a voltage is applied, and thereby gives pressure to the ink in the pressurizing chambers. Due to this, the ink is ejected from the nozzles. The flexible printed circuit is electrically interposed between the piezoelectric actuator substrate and a driver for control of drive of the piezoelectric actuator substrate.

CITATION LIST

Patent Literature

Patent Literature 1: Japanese Patent Publication No. 2010-105317A

SUMMARY OF INVENTION

Technical Problem

Since the flexible printed circuit covers the piezoelectric actuator substrate, it is liable to affect the bending deformation in the piezoelectric actuator substrate caused by the backward voltage effect. For example, if the flexible circuit contacts the piezoelectric actuator substrate above the pressurizing chambers, the load of the flexible circuit will be added to the piezoelectric actuator substrate at the pressurizing chamber side. As a result, the intended operation is liable to be unable to be correctly realized.

Accordingly, desirably there is provided an inkjet head capable of reducing the influence exerted by the flexible circuit upon the operation of the piezoelectric actuator substrate.

Solution to Problem

An inkjet head according to one aspect of the present invention has a passageway member having a nozzle which opens at a first major surface and a pressurizing chamber which is communicated with the nozzle and is positioned on a second major surface side constituting a back surface of the first major surface; a piezoelectric actuator substrate which is superimposed on the second major surface so as to cover the pressurizing chamber; and a flexible printed circuit having an insulating base film, an interconnects which is provided on one major surface of the base film, and an insulating film covering the interconnect, being arranged so that its insulating film side is made to face the side of the piezoelectric actuator substrate opposite to the passageway member, and being electrically connected to the piezoelectric actuator substrate. Above the pressurizing chamber, the thickness of the insulating film from the base film differs between one side and the other side in a predetermined direction along the second major surface.

A printer according to another aspect of the present invention is provided with said inkjet head, a scanning portion making media and the inkjet head relatively move, and a control unit controlling the inkjet head.

Advantageous Effects of Invention

According to the above configuration, an influence exerted by the flexible circuit upon the operation of the piezoelectric actuator substrate can be reduced.

DESCRIPTION OF EMBODIMENTS

Figure 1:
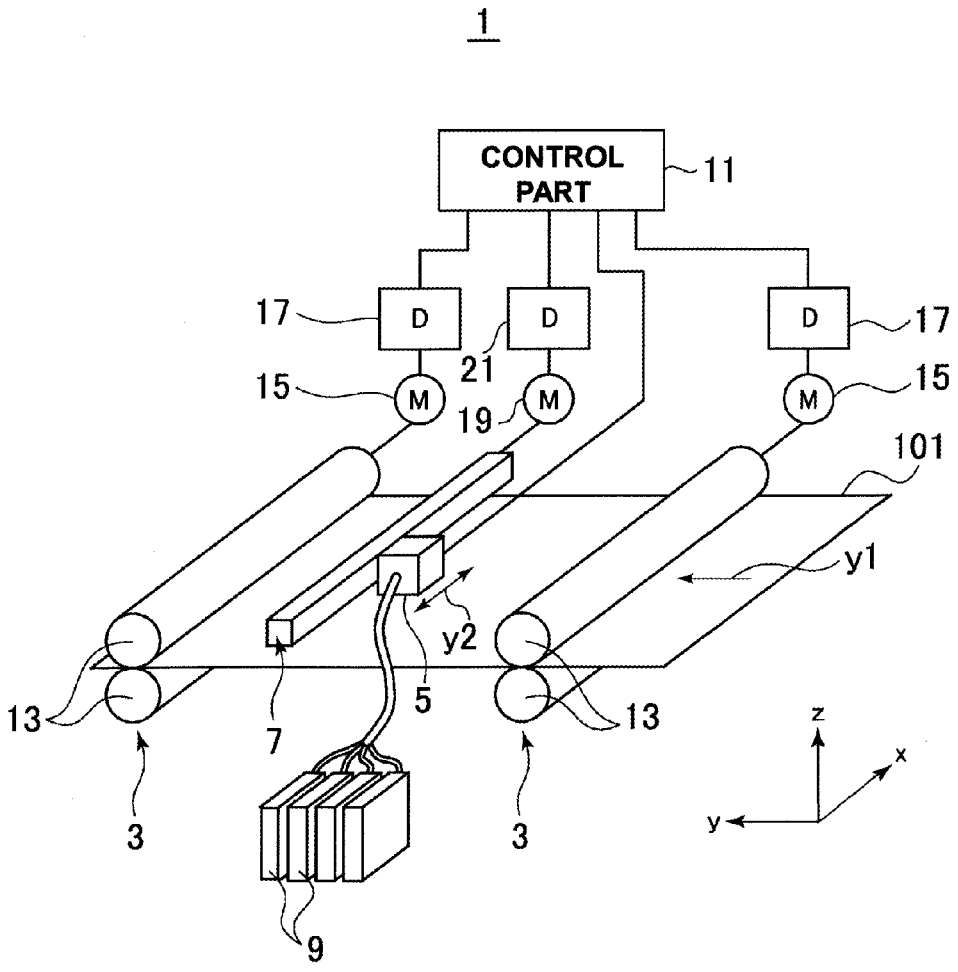
FIG. 1 A perspective view schematically showing a principal part of a printer according to an embodiment of the present invention.

FIG. 1 is a perspective view schematically showing a principal part of a printer 1 according to an embodiment of the present invention.

The printer 1 is an inkjet printer. More specifically, for example, the printer 1 is made a piezo-head type, serial-head type, and off-carriage type color printer. Note that, the printer 1 may realize a color image by a suitable number of colors of ink. In the present embodiment, a color image is realized by four colors of ink (black, yellow, magenta, and cyan).

The printer 1 for example has a conveyor unit 3 for conveying media (for example paper) 101 in a conveyance direction indicated by an arrow y1, a head 5 which ejects ink drops toward the media 101 which are being conveyed, a scanning portion 7 which makes the head 5 reciprocally move in a sub-scanning direction (arrow y2) perpendicular to the conveyance direction of the media 101, an ink cartridge 9 which supplies ink to the head 5, and a control unit 11 for controlling the operation of the printer 1 including an ejection operation of ink from the head 5.

Ink drops are repeatedly ejected from the head 5 to the media 101 over a broad range in a main scanning direction constituting a direction perpendicular to a sub-scanning direction while the head 5 is moved reciprocally by the scanning portion 7. Due to this, a belt-shaped two-dimensional image is formed on the media 101. Further, the media 101 are intermittently conveyed by the conveyor unit 3. Due to this, the belt-shaped two-dimensional images are connected and continuous two-dimensional images are formed on the media 101.

The conveyor unit 3, for example, conveys a plurality of media 101 which are stacked in a not shown supply stack to a not shown discharge stack one by one. The conveyor unit 3 may be given a known suitable configuration. FIG. 1 exemplifies a conveyor unit 3 in which the conveyance route is made a straight path and which has rollers 13 which abut against the media 101, motors 15 for rotating the rollers 13, and drivers 17 which give a driving electric power to the motors 15.

The scanning portion 7 may be given a known suitable configuration. For example, the scanning portion 7 has a not shown guide rail which supports a not shown cartridge having the head 5 mounted thereon so that it can be guided in the sub-scanning direction, a not shown belt fixed to the cartridge, not shown pulleys which the belt bridges, a motor 19 for rotating the pulleys, and a driver 21 which gives a driving electric power to the motor 19.

The ink cartridge 9 is arranged at a place which is different from the head 5 (so that it does not move together with the head 5). The ink cartridge 9 is connected through a flexible tube to the head 5. A plurality of (four in the present embodiment) ink cartridges 9 are provided corresponding to the number of colors of the ink ejected by the head 5.

The control unit 11 for example includes a CPU, ROM, RAM, and external memory device. The control unit 11 outputs control signals to the drivers 17 of the conveyor unit 3, the driver 21 of the scanning portion 7, and the driver (which will be explained later) of the head 5 and controls operations of the conveyor unit 3, scanning portion 7, and head 5.

Figure 2:
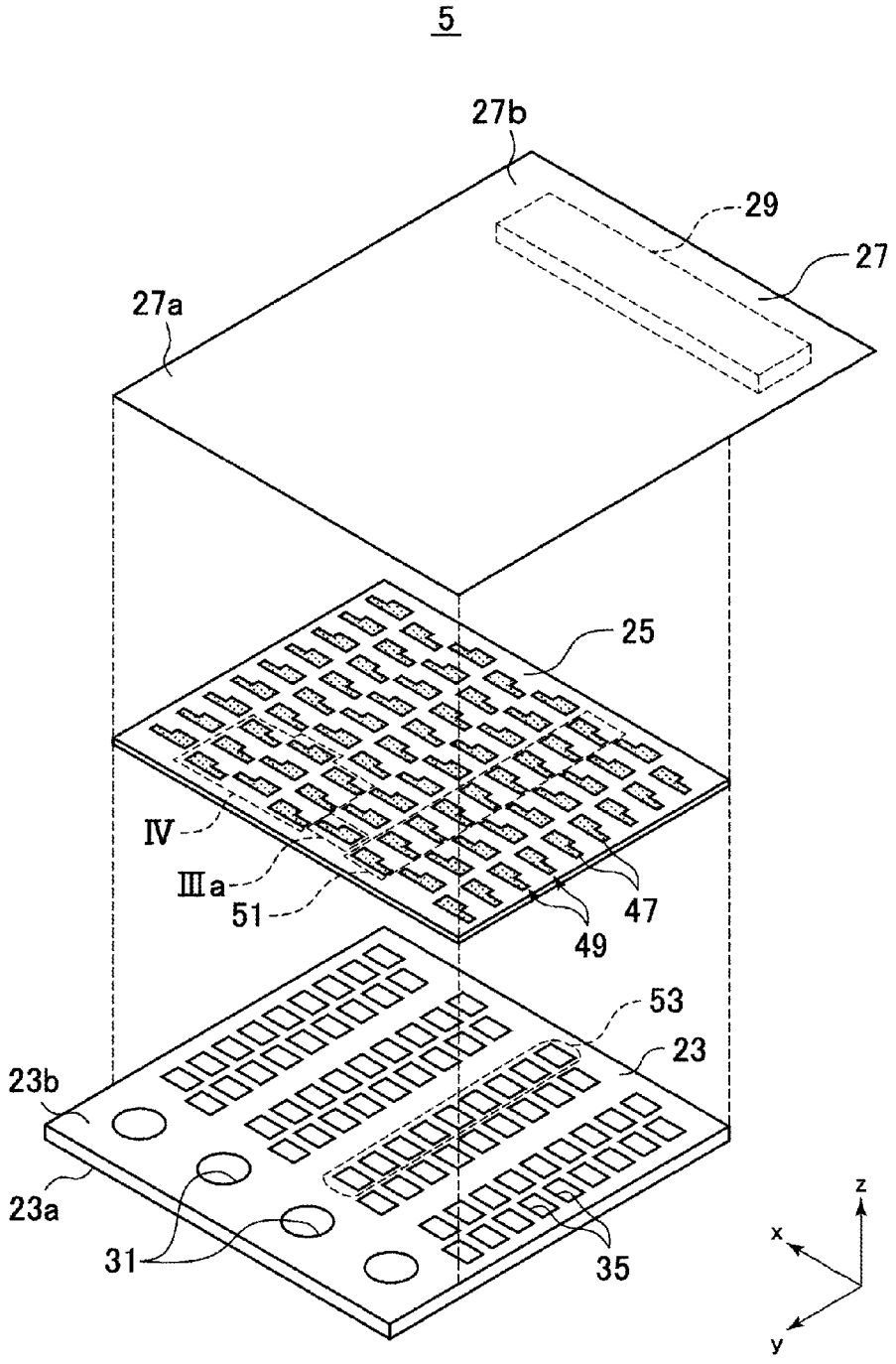
FIG. 2 A disassembled perspective view schematically showing a portion of an inkjet head of the printer in FIG. 1.

FIG. 2 is a disassembled perspective view showing a portion of the head 5. Note that, the part below the sheet surface (negative side in a z-direction) in FIG. 2 is the media 101 side.

The head 5 has a passageway member 23 configuring the ink passageways, a piezoelectric actuator substrate 25 which generates a driving power for ejecting ink from the passageway member 23, an FPC (flexible printed circuit) 27 which is electrically connected to the piezoelectric actuator substrate 25, and a driver IC 29 for controlling the drive of the piezoelectric actuator substrate 25 through the FPC 27.

The passageway member 23 is for example schematically formed in a thin rectangular plate shape and has a first major surface 23*a* facing the media 101 and a second major surface 23*b* on the back surface thereof. In the first major surface 23*a*, in order to eject ink drops, a plurality of nozzles which will be explained later are opened. Further, in the end part of the second major surface 23*b*, ink supply ports 31 to which ink is supplied are formed for each color.

The piezoelectric actuator substrate 25 is for example schematically formed in a thin rectangular plate shape and is superimposed on the second major surface 23*b* of the passageway member 23. The piezoelectric actuator substrate 25 is for example formed to a size large enough to cover most of the second major surface 23*b* (portion except area of arrangement of the plurality of ink supply ports 31).

The FPC 27 has a facing portion 27*a* covering the piezoelectric actuator substrate 25 and an extension portion 27*b* which extends outward from the former portion to the outside of the piezoelectric actuator substrate 25. Note that, the extension portion 27*b* may be provided in either the main scanning direction or sub-scanning direction.

The driver IC 29, for example, is mounted in the extension portion 27*b* on the major surface the same as the major surface on the side where the facing portion 27*a* faces the piezoelectric actuator substrate 25. Note that, the driver IC 29 may be arranged at a suitable position by bending the FPC 27. Further, the FPC 27 may be provided with two extension portions and each of the two extension portions may be provided with drivers IC 29 (two drivers IC 29 in total).

Figure 3A:
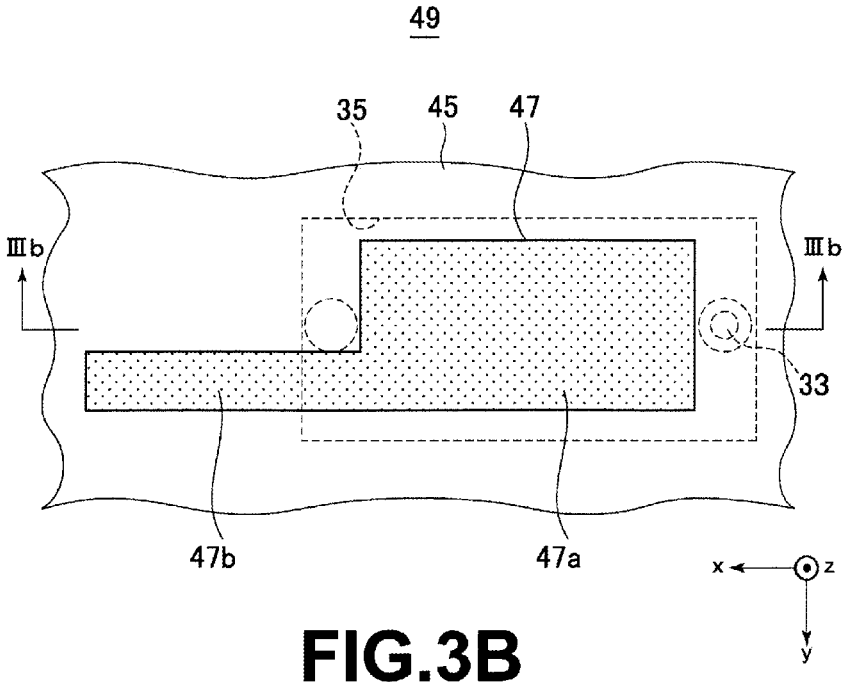
FIG. 3A is a plan view in an area IIIa in FIG. 2.
Figure 3B:
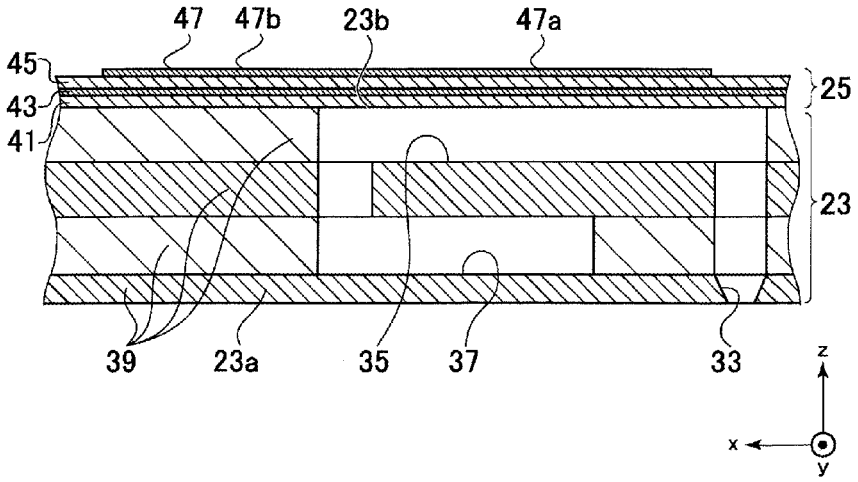
FIG. 3B is a cross-sectional view taken along the IIIb-IIIb line in FIG. 3A.

FIG. 3A is an enlarged plan view showing the passageway member 23 and piezoelectric actuator substrate 25 in an area corresponding to an area IIIa in FIG. 2, while FIG. 3B is a cross-sectional view taken along the IIIb-IIIb line in FIG. 3A.

As already explained, the passageway member 23 has a plurality of nozzles 33 which open at the first major surface 23*a*. Further, the passageway member 23 has a plurality of pressurizing chambers 35 (see FIG. 2 as well) which are communicated with the plurality of nozzles 33 and open at the second major surface 23*b* side and common passageways 37 for supplying ink from the ink supply ports 31 to the plurality of pressurizing chambers 35 (FIG. 3B).

Note that, the concrete shapes of these may be suitably set. For example, as shown in the present embodiment, a planar shape of a pressurizing chamber 35 may be roughly a rectangle in which the nozzle 33 is connected to the center of the short side. Further, for example, the planar shape of the pressurizing chamber 35 may be a diamond in which the nozzle 33 is connected to a corner portion or may be an ellipse or oval in which the nozzle 33 is connected to a semicircular end part.

The passageway member 23 is for example comprised by stacking a plurality of plate-shaped members 39 in the z-direction, the plate members 39 being formed with through holes or grooves which become the passageways. The plurality of plate-shaped members 39 are for example made of a metal. Note that, the plate-shaped member 39 configuring the first major surface 23*a* may be comprised by a resin, while the other plate-shaped members 39 may be comprised by a metal.

The piezoelectric actuator substrate 25 is configured by for example a unimorph type piezoelectric actuator substrate and is comprised by stacking, from the passageway member 23 side, in order, an elastic body 41, a common electrode 43, a piezoelectric body 45, and a plurality of individual electrodes 47 (see FIG. 2 as well). Note that, these are all formed in layer shapes (plate shapes).

The elastic body 41 forms the upper surface of the plurality of pressurizing chambers 35. When a voltage is applied between an individual electrode 47 and the common electrode 43, the piezoelectric body 45 contracts in a planar direction according to an inverse piezoelectric effect. Due to this, the elastic body 41 warps to the pressurizing chamber 35 side. By utilization of this action, pressure is given to the ink in a pressurizing chamber 35, and an ink drop is ejected from a nozzle 33.

The elastic body 41, common electrode 43, and piezoelectric body 45 are provided over the plurality of pressurizing chambers 35 as a whole. On the other hand, an individual electrode 47 is provided for each pressurizing chamber 35. The common electrode 43 is, for example, given a reference potential. The plurality of individual electrodes 47 are selectively given potentials (driving signals) which are different from that for the common electrode 43. Due to this, ink drops are selectively ejected from the plurality of nozzles 33.

Each of the plurality of individual electrodes 47 has an electrode body 47*a* which is superimposed over substantially an entire pressurizing chamber 35 and applies voltage to the piezoelectric body 45 and has a leadout electrode 47*b* for connection with the FPC 27. The electrode body 47*a* is for example given a shape roughly the same as (resembling) the planar shape of the pressurizing chamber 35. In the present embodiment, it is rectangular and is smaller than the pressurizing chamber 35. The leadout electrode 47*b* extends outward in a suitable direction from the electrode body 47*a*. For example, the leadout electrode 47*b* extends outward to the opposite side from the nozzle 33 relative to the electrode body 47*a* up to a position where it is not superimposed over the pressurizing chamber 35. When the piezoelectric body 45 sandwiched between an individual electrode 47 and the common electrode 43 contracts in the planar direction and thereby the elastic body 41 bends to the pressurizing chamber 35 side, the piezoelectric body 45 at a peripheral portion of the pressurizing chamber 35 ends up being extended in the planar direction. For this reason, when the piezoelectric body 45 at a peripheral portion of the pressurizing chamber 35 contracts in the planar direction according to the inverse piezoelectric effect, the amount of deflection rather ends up becoming small. For this reason, at a peripheral portion of the pressurizing chamber 35, no electrode other than the leadout electrode 47*b* for transmitting the driving signal is provided.

Note that, in the following description, in the passageway member 23 and piezoelectric actuator substrate 25, a portion shown in FIG. 3 and corresponding to one nozzle 33 (substantially an area for arrangement of a pressurizing chamber 35 and an individual electrode 47 when viewed on a plane) will be sometimes referred to as an "ejection element 49".

Figure 4:
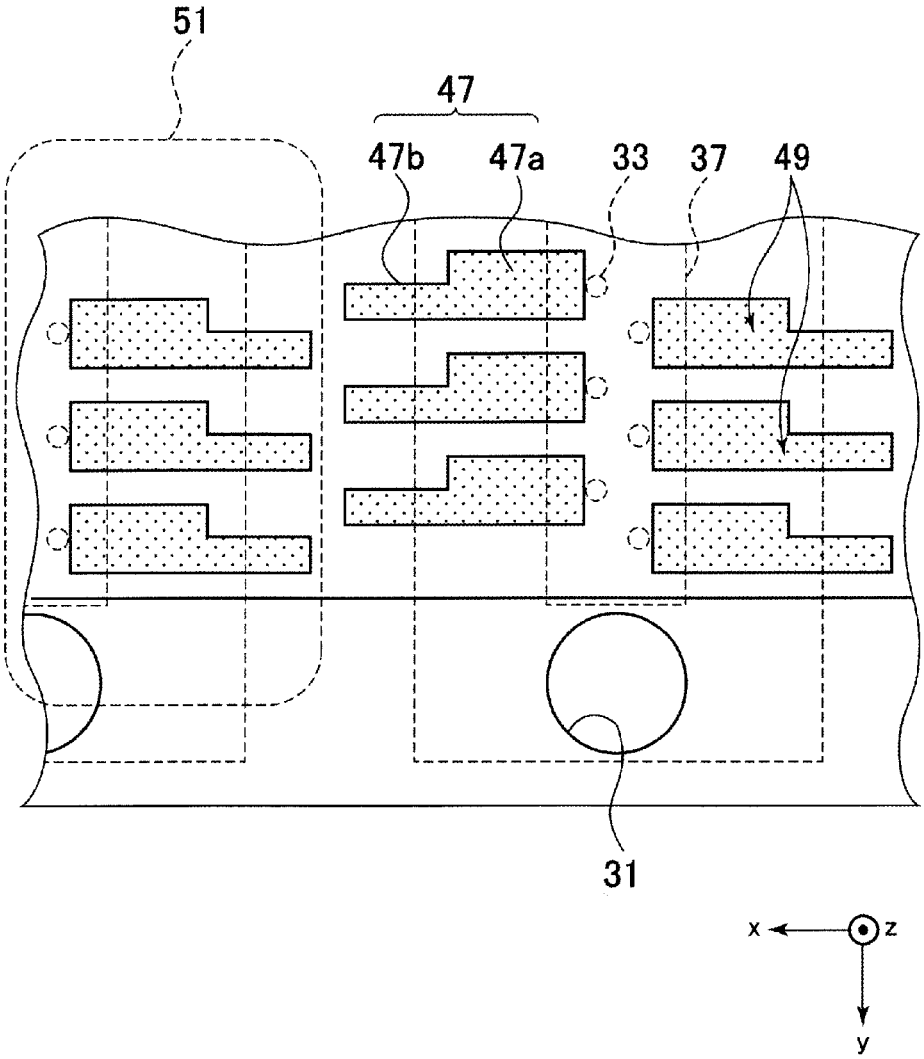
FIG. 4 An enlarged view near an area IV in FIG. 2.

FIG. 4 is a plan view showing the passageway member 23 and piezoelectric actuator substrate 25 in an area roughly corresponding to an area IV in FIG. 2.

As shown in FIG. 2 and FIG. 4, a plurality of ejection elements 49 are arranged in the main scanning direction and sub-scanning direction. Specifically, for example, this is as follows.

Each of the plurality of ejection elements 49 is arranged so that a direction of arrangement of the nozzle 33 relative to the pressurizing chamber 35 and of extension of the leadout electrode 47*b* relative to the electrode body 47*a* matches with the sub-scanning direction (x-direction).

In a row of ejection elements 49 (ejection element row 51) comprised of a plurality of ejection elements 49 arranged in the main scanning direction (y-direction), the plurality of ejection elements 49 are given the same orientations as each other. Between adjacent ejection element rows 51, the orientations of the nozzles 33 (leadout electrodes 47*b*) are made reverse to each other. Further, the rows are arranged so as to be offset from each other in the scanning direction by a size of half of an ejection element 47 in the main scanning direction.

Two ejection element rows 51 having nozzle sides 33 made to face to each other correspond to one type of ink. In the present embodiment, corresponding to the four colors, provision is made of eight ejection element rows 51 in total. Note that, the number of ejection element rows 51 may be different for each color as well. For example, the number of ejection element rows 51 for the black ink may be made larger.

Note that, as apparent from the fact that a plurality of ejection elements 49 form a plurality of ejection element rows 51, pluralities of pressurizing chambers 35 are arranged in the main scanning direction (y-direction) to form pressurizing chamber rows 53 (FIG. 2), while the plurality of pressurizing chamber rows 53 are aligned in the sub-scanning direction (x-direction).

As shown in FIG. 4, the common passageways 37 are connected to the ink supply ports 31 and are branched corresponding to the number of the ejection element rows 51 to extend along the ejection element rows 51.

Figure 5:
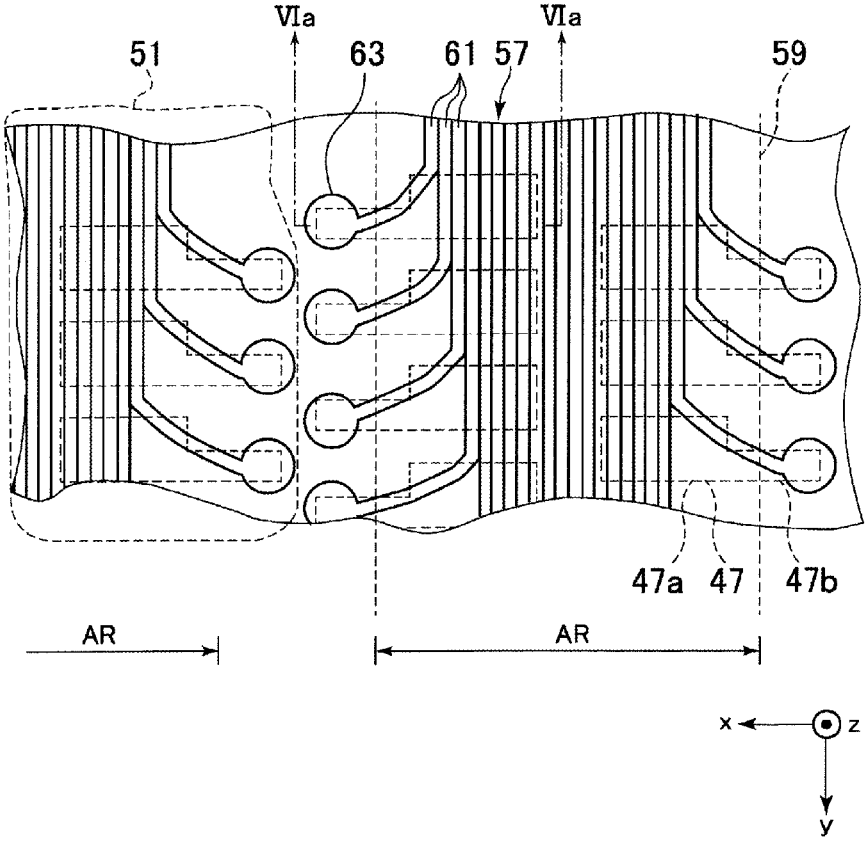
FIG. 5 A plan view showing interconnects of a flexible printed circuit of the inkjet head in FIG. 2.
Figure 6A:
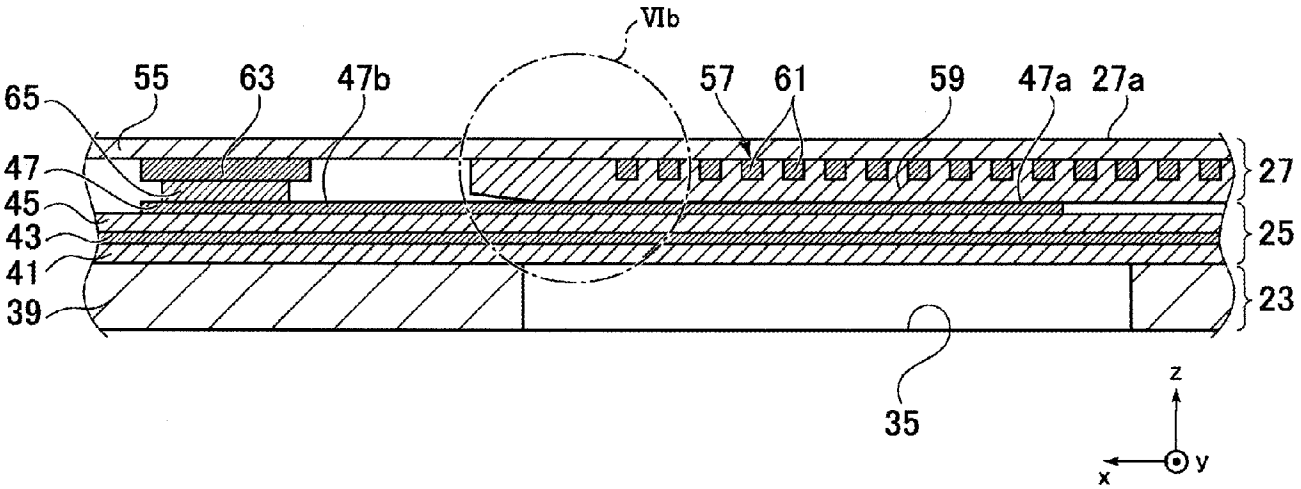
FIG. 6A is a cross-sectional view taken along a VIa-VIa line in FIG. 5.

FIG. 5 is a see-through plan view showing the interconnect patterns of the FPC 27 for an area having a size equal to the area shown in FIG. 4. FIG. 6A is a cross-sectional view taken along a VIa-VIa line in FIG. 5 showing the plate-shaped member 39 at the uppermost layer in the passageway member 23, the piezoelectric actuator substrate 25, and the FPC 27.

The FPC 27, as shown in FIG. 6A, has an insulating base film 55, a conductor pattern 57 formed on the base film 55, and an insulating film 59 covering the conductor pattern 57. Further, the facing portion 27*a* of the FPC 27 is arranged so that its insulating film 59 side is made to face the piezoelectric actuator substrate 25 side.

The base film 55 is for example made of a flexible resin film. The thickness of the base film 55 is for example about 20 μm to 200 μm. The conductor pattern 57 is for example made of metal such as copper. The thickness of the conductor pattern 57 is for example about 5 μm to 20 μm. The insulating film 59 is for example made of a solder resist. The solder resist is for example made of a thermoplastic epoxy resin containing a pigment or the like. The thickness of the insulating film 59 is for example made thicker by about 5 μm to 20 μm than the thickness of the conductor pattern 57.

As shown in FIG. 5 and FIG. 6A, the conductor pattern 57 includes a plurality of interconnects 61 and a plurality of pads 63 which are provided on the front ends of the plurality of interconnects 61.

The plurality of interconnects 61 for example extend aligned with (for example in parallel with) each other along the ejection element rows 51 so that they are superimposed on the ejection element rows 51 (pressurizing chamber rows 53). However, the plurality of interconnects 61 (bundles or areas for arrangement thereof) extend at positions offset from the ejection element rows 51 to the sides opposite to the leadout electrode 47*b* sides. For example, the plurality of interconnects 61 are not superimposed on the leadout electrodes 47*b* sides of the pressurizing chambers 35, but are superimposed on the sides of the pressurizing chambers 35 opposite to the leadout electrodes 47*b*. From another viewpoint, the plurality of interconnects 61 extend so that they are superimposed between two ejection element rows 51 having sides opposite to the leadout electrode 47*b* sides facing each other.

In FIG. 5, in the plurality of interconnects 61, for example, the upper sides from the sheet surface (negative side of y-direction) are the sides connected to the driver IC 29. As shown in FIG. 5, the plurality of interconnects 61, in the process of extension from the driver IC 29 side along the ejection element rows 51, are bent and extend toward the leadout electrodes 47*b* in turn from the interconnects 61 which are positioned outside. Pads 63 are provided at their front ends.

The pads 63 and the leadout electrodes 47*b* face each other and are bonded by bumps 65 (FIG. 6A). Due to this, the driver IC 29 is electrically connected through the interconnects 61 to the individual electrodes 47. Further, the FPC 27 is fixed with respect to the piezoelectric actuator substrate 25. The bumps 65 may be formed by a suitable material having conductivity. For example, the bumps 65 are comprised of a resin (for example thermosetting resin) containing particles made of metal (for example Ag). The thickness of the bumps 65 is for example about 5 μm to 20 μm. The distance between the individual electrodes 47 and the conductor pattern 57 is almost the same as the thickness of the bumps 65. Therefore. the distance between the individual electrodes 47 and the insulating film 59 is the thickness of the bumps 65 or less.

As shown in FIG. 5 and FIG. 6A, the insulating film 59 covers the plurality of interconnects 61 while exposing the pads 63. Due to this, the plurality of interconnects 61 are reduced in short-circuits with each other due to deposition of conductive material and so on. Note that, in FIG. 5, a range AR indicates the width of the insulating film 59. The insulating film 59 has a width by which it can be superimposed over at least a portion of the pressurizing chambers 35.

As shown in FIG. 6A, due to the interposition of the bumps 65 between the leadout electrodes 47*b* and the pads 63, the individual electrodes 47 and the insulating film 59 are in a state where they contact each other with a relatively low pressure or face each other with a very small gap (for example 20 μm or less, further 10 μm or less). In other words, the distance of the portions having the narrowest distance between the individual electrodes 47 and the insulating film 59 above the pressurizing chambers 35 becomes 20 μm or less, further 10 μm or less. If considering that the individual electrodes 47 are portions of the piezoelectric actuator substrate 25, this means that the distance of the portions having the narrowest distance between the piezoelectric actuator substrate 25 and the insulating film 59 above the pressurizing chambers 35 becomes 20 μm or less, further 10 μm or less.

Note that, such state is for example realized by bonding the FPC 27 to the piezoelectric actuator substrate 25 in the following way. First, the leadout electrodes 47*b* are coated with an uncured material for forming the bumps 65. Next, the FPC 27 is placed over the piezoelectric actuator substrate 25, then the FPC 27 is pressed against the piezoelectric actuator substrate 25. At this time, the material for forming the bumps 65 is crushed (deformed), and the insulating film 59 contacts or approaches the piezoelectric actuator substrate 25. After that, the material for forming the bumps 65 is heated to cure it. By performing such processing, the thickness of the bumps 65 substantially becomes the thickness of the insulating film 59 minus the thickness of the pads 63.

Figure 6B:
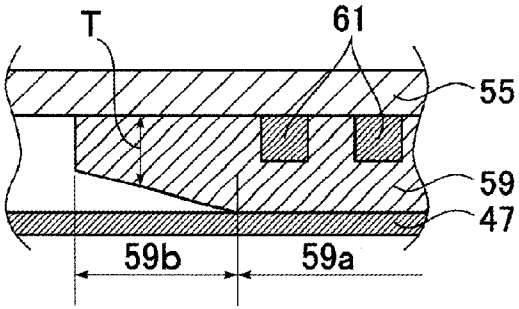
FIG. 6B is an enlarged view of an area VIb in FIG. 6A.

FIG. 6B is an enlarged view of an area VIb in FIG. 6A

As shown in FIG. 6A and FIG. 6B, the thickness T of the insulating film 59 from the base film 55 becomes thinner at the end part side than that at the side of the plurality of interconnects 61. That is, the insulating film 59 has a thick portion 59*a* and thin portion 59*b*. Further, this change of thickness occurs above the pressurizing chambers 35. That is, above the pressurizing chambers 35, the thickness T becomes thinner at the side opposite to the side of the plurality of interconnects 61.

Such a change of thickness of the insulating film 59 can be suitably caused. For example, while depending on the method of formation of the insulating film 59, the area for arrangement of the plurality of interconnects 61 is apt to become greater in thickness T compared with a non-arrangement area. For example, when screen printing is used to coat a solder resist to form the insulating film 59, the insulating film 59 becomes greater in thickness T in the area for arrangement for the plurality of interconnects 61 and becomes thinner at the non-arrangement areas, that is, the end parts. Note that, in place of or addition to this method, for example, it is also possible to coat the entire formation area of the insulating film 59 with a solder resist or other material, then coat the material again only at an area where the thickness T is desired to be increased.

The driver IC 29 shown in FIG. 2 is electrically connected through the FPC 27 to the plurality of individual electrodes 47 as already explained. Further, although not particularly shown, the piezoelectric actuator substrate 25 is provided with the pads which are connected to the common electrode 43, and the interconnects and pads of the FPC 27 are bonded to these pads, therefore the driver IC 29 is electrically connected to the common electrode 43.

To the driver IC 29, for example, data on the amount of ink to be ejected is input from the control unit 11 for all nozzles 33 every predetermined drive cycle. The driver IC 29, for example, imparts a reference potential to the common electrode 43 and selectively outputs driving signals having predetermined waveforms to the plurality of individual electrodes 47 based on the input data. Further, the driver IC 29, for example, sets a number of times for outputting the driving signals in a drive cycle based on the input data.

As described above, in the present embodiment, the head 5 has the passageway member 23, piezoelectric actuator substrate 25, and FPC 27. The passageway member 23 has the nozzles 33 which open at the first major surface 23*a* and the pressurizing chambers 35 which are communicated with the nozzles 33 and open at the second major surface 23*b* constituted by the back surface of the first major surface 23*a*. The piezoelectric actuator substrate 25 is superimposed over the second major surface 23*b* and covers the pressurizing chambers 35 (in the illustrated example, closes the pressurizing chambers 35). As the passageway member 23, use may be also made of a member where a plate-shaped member 39 is further provided at the open sides of the pressurizing chambers 35 so as to close the pressurizing chambers 35. In this case, the major surface of that plate-shaped member 39 at the opposite side to the pressurizing chambers 35 is the second major surface 23*b*, and the piezoelectric actuator substrate 25 is superimposed over this second major surface 23*b*. By arranging the pressurizing chambers 35 at the second major surface 23*b* side in the passageway member 23, a pressure generated in the piezoelectric actuator substrate 25 arranged so as to cover the pressurizing chambers 35 is transmitted to the pressurizing chambers 35 through the plate-shaped member 39 provided over the pressurizing chambers 35. By such an arrangement, for example, it is possible to reduce the possibility of a solvent etc. of the ink affecting the reliability of the piezoelectric actuator substrate 25. The FPC 27 has the insulating base film 55, interconnects 61 which are provided on one major surface of the base film 55, and the insulating film 59 covering the interconnects 61, is arranged so that its insulating film 59 side faces the side of the piezoelectric actuator substrate 25 opposite to the passageway member 23, and is electrically connected to the piezoelectric actuator substrate 25. Above the pressurizing chambers 35, the thickness T of the insulating film 59 from the base film 55 is different between one side (interconnect 61 side) and the other side in a predetermined direction (x-direction) along the second major surface 23*b*.

Accordingly, above the pressurizing chambers 35, the thick portions of the insulating film 59 form spacers so that contact of the thin portions with the piezoelectric actuator substrate 25 (individual electrodes 47) is suppressed. As a result, the influence of the FPC 27 upon the operation of the piezoelectric actuator substrate 25 can be reduced. Specifically, for example, addition of the load of the FPC 27 to the piezoelectric actuator substrate 25 above the pressurizing chambers 35 is suppressed. Further, for example, close contact of the FPC 27 with the individual electrodes 47 in at least a portion above the pressurizing chambers 35 is suppressed. Therefore, when the individual electrodes 47 separate from the FPC 27, air easily enters the space between the two, therefore resistance due to negative pressure between the two is reduced. The effect as described above acts more effectively in a case where the distance of the portion above the pressurizing chambers 35 in which the distance between the individual electrodes 47 and the insulating film 59 becomes the narrowest becomes 20 μm or less, further 10 μm or less. Further, preferably the FPC 27 has a small amount of sag due to its own weight, and preferably the load which is added to the piezoelectric actuator substrate 25 above the pressurizing chambers 35 is small. For this reason, preferably the thickness of the base film 55 is 100 μm or less. Further, preferably the thickness of the conductor pattern 57 is 10 μm or less. Further, preferably the increase in thickness of the insulating film 59 over the thickness of the conductor pattern 57 is 15 μm or less.

Further, in the present embodiment, the plurality of interconnects 61 are positioned above the pressurizing chambers 35 to one side, and the thickness T of the insulating film 59 from the base film 55 becomes thicker at that one side (side of the plurality of interconnects 61) than the other side.

Accordingly, depending on the method of formation of the insulating film 59, it is possible to utilize the phenomenon of the thickness T easily becoming greater in the area for arrangement of the plurality of interconnects 61 so as to easily make the thickness T above the pressurizing chambers 35 different between one side and the other side.

Further, in the present embodiment, the leadout electrodes 47*b* are led out from the pressurizing chambers 35 at the side where the thickness T of the insulating film 59 from the base film 55 becomes thin. The portion where the leadout electrodes 47*b* are provided is a portion at the peripheral portions of the pressurizing chambers 35 where vibration caused by the driving signal is large, so is a portion greatly influenced by contact of the insulating film 59. By the thickness T of the insulating film 59 on the side where the leadout electrodes 47*b* are led out becoming thin, it is possible to reduce this influence.

Figure 7:
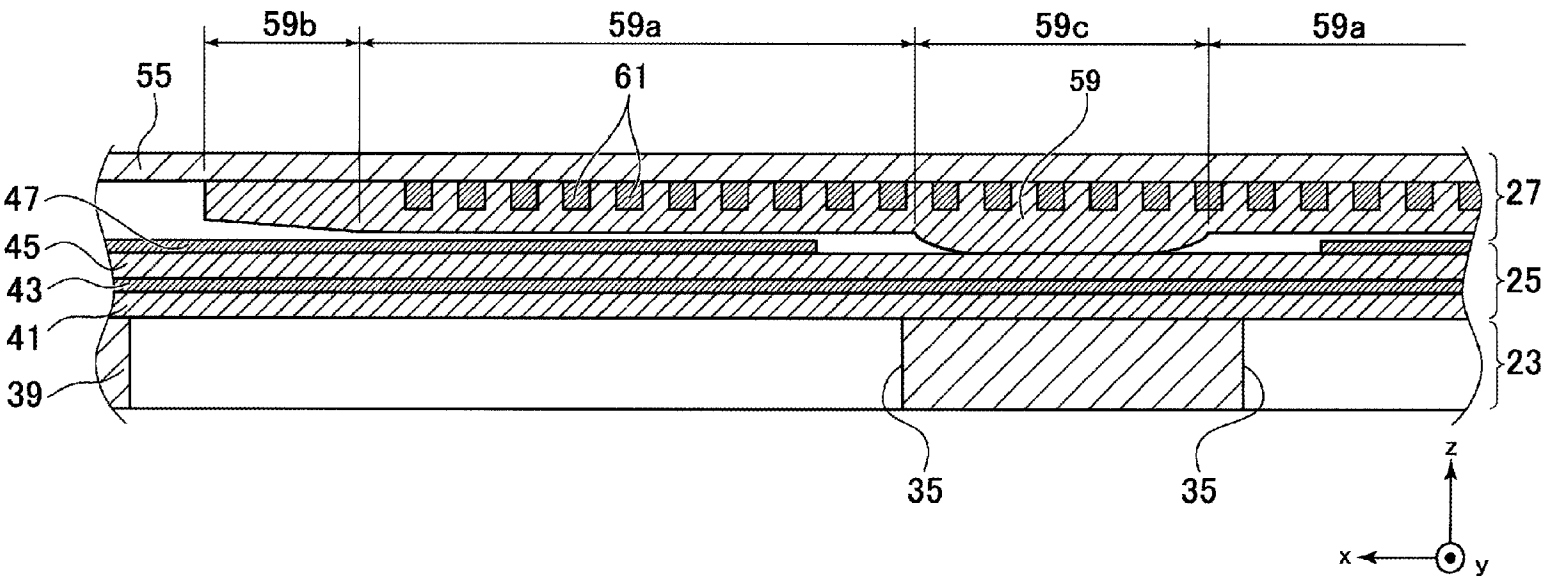
FIG. 7 A cross-sectional view corresponding to FIG. 6A and showing a modification of the flexible circuit.

FIG. 7 is a cross-sectional view corresponding FIG. 6A and shows a modification of the FPC 27.

In this modification, the insulating film 59 has a portion (second thick portion 59*c*) between the pressurizing chamber rows 53 (see FIG. 2) in which the thickness T (see FIG. 6B) from the base film 55 is thicker than at the portions (thick portion 59*a* and thin portion 59*b*) positioned above the pressurizing chambers 35. The second thick portion 59*c* for example extends along the pressurizing chamber rows 53 and has a length long enough to cover all of the plurality of pressurizing chambers 35 of each pressurizing chamber row 53.

The second thick portion 59*c* may be formed by the same technique as that for forming the thick portion 59*a* with respect to the thin portion 59*b*. For example, the second thick portion 59*c* may be formed by making the density of the interconnects 61 higher than that in the thick portion 59*a* or by coating a material which forms the insulating film 59 between the pressurizing chamber rows 53 a number of times larger than that for the portions above the pressurizing chambers 35.

According to such a configuration, contact of the insulating film 59 with the piezoelectric actuator substrate 25 (individual electrodes 47) above the pressurizing chambers 35 is further suppressed, therefore the influence of the FPC 27 upon the operation of the piezoelectric actuator substrate 25 can be reduced more.

Further, in this modification, an end part of the insulating film 59 is positioned above the pressurizing chambers 35. Accordingly, in the area above the pressurizing chambers 35, the insulating film 59 does not contact the piezoelectric actuator substrate 25 at the outer side from the end part of the insulating film 59. From another viewpoint, the insulating film 59 forms a spacer, so in a partial area above the pressurizing chambers 35, contact of the FPC 27 (base film 55) with the piezoelectric actuator substrate 25 is suppressed. As a result, the influence of the FPC 27 upon the operation of the piezoelectric actuator substrate 25 can be reduced more.

Figure 8A:
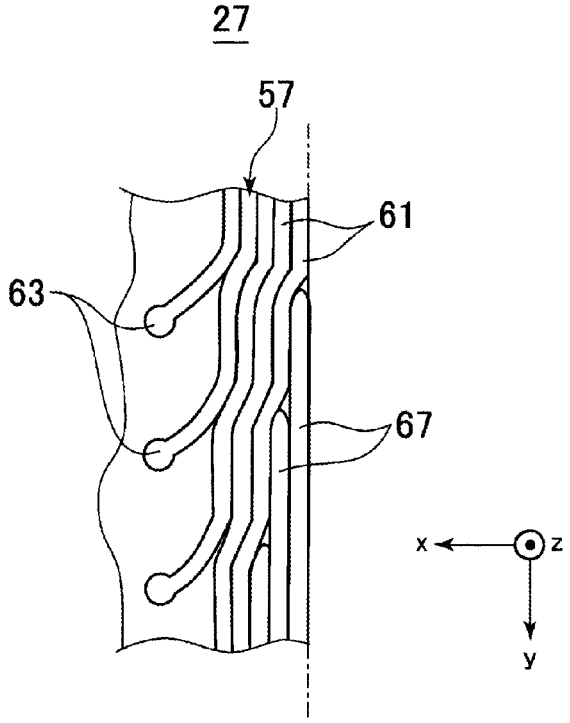
FIG. 8A and FIG. 8B are plan views showing modifications of conductor pattern of the flexible circuit.
Figure 8B:
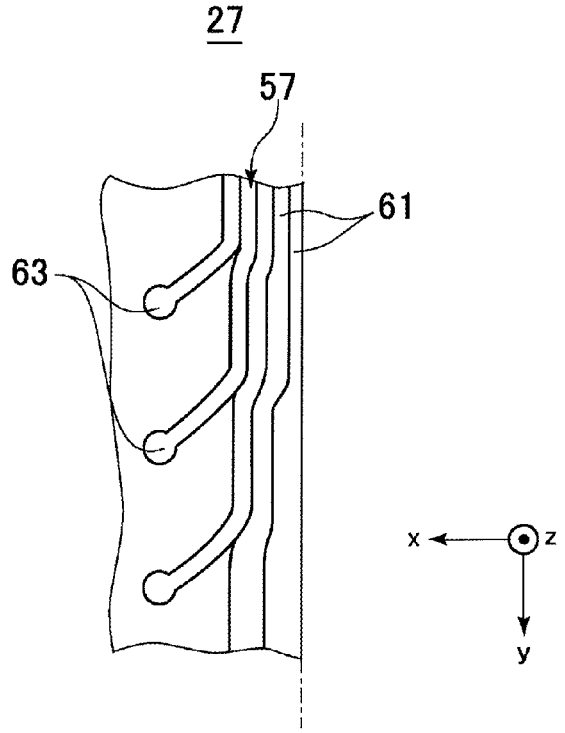

FIG. 8A and FIG. 8B are plan views showing modifications of the conductor pattern 57 of the FPC 27.

In this embodiment, as explained with reference to FIG. 5, the plurality of interconnects 61 are bent outward and extend to above the leadout electrodes 47*b* in order from the outside interconnect. As a result, the width of the area for arrangement of the plurality of interconnects 61 becomes gradually narrower. In the modifications in FIG. 8A and FIG. 8B, the conductor patterns 57 are formed so that widths of areas of arrangement of the plurality of interconnects are kept constant over the plurality of pressurizing chambers 35.

In the example in FIG. 8A, the plurality of interconnects 61 extend from the driver IC 29 side along the pressurizing chamber rows 53. Along with this, the plurality of interconnects 61 are gradually offset to the outside. Further, the number of dummy interconnects 67 which extend to the inner side from the plurality of interconnects 61 in parallel with the plurality of interconnects 61 is gradually increased. The dummy interconnects 67 may be rendered an electrically floating state or may be connected to the reference potential.

Further, the distance between the plurality of interconnects 61 and the dummy interconnects 67 may be made larger than the distance between the interconnects 61 themselves and the distance between the dummy interconnects themselves 67 as well. When setting the distances in this way, the insulating film 59 which is positioned between the plurality of interconnects 61 and the dummy interconnects 67 can be formed as a thin portion having a thinner thickness than that of the insulating film 59 above the interconnects 61 and the insulating film 59 above the dummy interconnects 67.

In the example in FIG. 8B, the plurality of interconnects 61 extend from the driver IC 29 side along the pressurizing chamber rows 53. Along with this, the remaining interconnects 61 are gradually increased in width. Note that, in FIG. 8B, the widths of all of the remaining interconnects 61 are made gradually larger, but the width of a specific interconnect 61 may be made larger as well.

As already explained, depending on the method of formation of the insulating film 59, the thickness of the insulating film 59 from the base film 55 becomes greater in the area for arrangement of the plurality of interconnects 61. Therefore, by keeping the width of the area for arrangement of the plurality of interconnects 61 (and dummy interconnects 67) constant over the plurality of pressurizing chambers 35 as shown in FIG. 8A and FIG. 8B, the width of a thick part in the insulating film 59 (thick portion 59*a*) can be made constant for the plurality of pressurizing chambers 35. As a result, the influence by the FPC 27 upon the plurality of pressurizing chambers 35 can be made uniform.

Note that, the width of the area for arrangement of the interconnects being "constant" as referred to here may be deemed a smaller change of the width of the area for arrangement of interconnects compared with that in the embodiment explained with reference to FIG. 5. Accordingly, for example, so long as the change of the width of the area for arrangement of the plurality of interconnects over the plurality of pressurizing chambers 35 is smaller than the width of one interconnect 61, the width of the area for arrangement of the plurality of interconnects is "constant" over the plurality of pressurizing chambers 35. In a case where the width of one interconnect 61 changes as shown in FIG. 8B, for example, judgment may be carried out by using the minimum value of the width of one interconnect 61 as the standard. A local change of area for arrangement at the position where an interconnect 61 is branched may be ignored. The width of the area for arrangement of the interconnects preferably changes within a range up to ±20%, more preferably within a range up to ±10% except for the local change explained before.

The present invention is not limited to the above embodiments or modifications and can be worked in various ways.

For example, the printer (inkjet head) is not limited to a serial-head type and off-cartridge type. For example, the printer may be a line-head type and/or on-cartridge type as well. The configuration of the portions in the printer other than the inkjet head (for example the conveyor part for media) may be a suitable configuration other than the exemplified configuration. The media are not limited to paper either and may be made of metal or plastic.

REFERENCE SIGNS LIST

5 . . . head, 23 . . . passageway member, 23*a* . . . first major surface, 23*b* . . . second major surface, 33 . . . nozzle, 35 . . . pressurizing chamber, 25 . . . piezoelectric actuator substrate, 27 . . . FPC (flexible printed circuit), 55 . . . base film, 59 . . . insulating film, and 61 . . . interconnect.

The invention claimed is:

1. An inkjet head comprising:

a passageway member having a nozzle which is opened at a first major surface, and a pressurizing chamber which is communicated with the nozzle and is positioned on a second major surface side opposite the first major surface;

a piezoelectric actuator substrate which is superimposed on the second major surface so as to cover the pressurizing chamber, the piezoelectric actuator substrate comprising a piezoelectric body and an electrode disposed on a surface of the piezoelectric body; and a flexible printed circuit having an insulating base film, an interconnect which is provided on one major surface of the insulting base film, and an insulating film covering the interconnect, the flexible printed circuit arranged so that at least a part of the insulating film contacts one of the electrode and the surface of the piezoelectric body of the piezoelectric actuator substrate, the part of the insulating film is not joined to the electrode and the part of the insulating film is not joined to the surface of the piezoelectric body, and the flexible printed circuit electrically connected to the piezoelectric actuator substrate; wherein, above the pressurizing chamber, a thickness of the insulating film extending from the base film toward the piezoelectric actuator substrate differs between one side of the insulating film and an other side of the insulating film in a predetermined direction.

2. An inkjet head as set forth in claim 1, wherein:

a plurality of interconnects are positioned at the one side above the pressurizing chamber, and the thickness of the insulating film from the base film becomes thicker at the one side than the other side.

3. An inkjet head as set forth in claim 2, wherein:

a plurality of pressurizing chambers are arranged, and the plurality of interconnects extend along the plurality of pressurizing chambers, and a width of an area for arrangement of the plurality of interconnects is made constant over the plurality of pressurizing chambers.

4. An inkjet head as set forth in claim 1, wherein:

at least two rows of pressurizing chambers are configured by pluralities of the pressurizing chambers arranged in lines, and the insulating film has a portion which is thicker than a portion above the pluralities of pressurizing chambers between adjacent rows of the pressurizing chambers.

5. An inkjet head as set forth in claim 1, wherein an end part of the insulating film is positioned above the pressurizing chamber.

6. An inkjet head as set forth in claim 1, having a portion at which the piezoelectric actuator substrate and the insulating film are arranged at an interval of 20 μm or less above the pressurizing chamber.

7. A printer comprising:

an inkjet head according to claim 1, a scanning portion causing media and the inkjet head relatively move, and a control unit that controls the inkjet head.

8. An inkjet head comprising:

a passageway member including a pressurizing chamber;

a piezoelectric actuator substrate disposed on the passageway member and covering the pressurizing chamber, the piezoelectric actuator substrate comprising a piezoelectric body and an electrode disposed on a surface of the piezoelectric body;

a flexible printed circuit including an insulating layer disposed on a side of the piezoelectric actuator substrate opposite to the passageway member, and a conductor pattern electrically connected to the piezoelectric actuator substrate and covered by an insulating film, wherein the insulating film includes a first portion and a second portion positioned above the pressurizing chamber, the second portion is thinner than the first portion, and at least a part of the first portion of the insulating film contacts one of the electrode and the surface of the piezoelectric body of the piezoelectric actuator substrate; and the part of the insulating film is not joined to the electrode and the part of the insulating film is not joined to the surface of the piezoelectric body.

9. An inkjet head according to claim 8, wherein the first portion covers the conductor pattern.

10. An inkjet head according to claim 8, wherein the first portion is positioned above the pressurizing chamber.

11. An inkjet head according to claim 8, wherein the second portion is positioned in an edge side of the insulating film.

12. An inkjet head according to claim 8, wherein a thickness of the second portion decreases toward an edge side of the insulating film.

13. An inkjet head according to claim 8, wherein the piezoelectric actuator substrate comprises a piezoelectric body, an electrode body providing a driving signal to the piezoelectric body, and a leadout electrode electrically connected to the flexible printed circuit, wherein the leadout electrode has a middle portion connected with the electrode body and positioned above the pressurizing chamber, and an edge portion led out from the middle portion to a position not above the pressurizing chamber, wherein the middle portion faces the second portion.

14. An inkjet head according to claim 13, wherein the passageway member includes a nozzle communicated with the pressurizing chamber, wherein the edge portion is led out toward a direction opposite to the nozzle.

15. An inkjet head according to claim 14, wherein the insulating film includes a third portion positioned above the nozzle, wherein the second portion is thinner than the third portion.

16. An inkjet head according to claim 13, the conductor pattern includes a first interconnect extending straight, and a second interconnect bent and extending toward and electrically connected to the edge portion.

17. An inkjet head according to claim 16, wherein the second interconnect includes a pad in an end portion thereof, and the pad is electrically connected to the edge portion.

18. An inkjet head according to claim 17, wherein the pad has a circular shape.

19. An inkjet head according to claim 16, wherein the insulating layer covers the first interconnect and does not cover the pad.

20. A printer comprising:

an inkjet head according to claim 8, a scanning portion causing media and the inkjet head relatively move, and a control unit that controls the inkjet head.

* * * * *